United States Patent [19]

Ito

[11] 4,432,496

[45] Feb. 21, 1984

[54] FOAM LIQUID DISPENSING DEVICE

[75] Inventor: Kazuo Ito, Kamakura, Japan

[73] Assignee: Toyo Seikan Kaisha, Ltd., Tokyo, Japan

[21] Appl. No.: 328,688

[22] Filed: Dec. 8, 1981

[51] Int. Cl.³ ..... B65D 1/32

[52] U.S. Cl. ..... 239/327; 222/189; 222/190; 222/212; 222/524; 239/539

[58] Field of Search ..... 222/189, 190, 211, 212, 222/521, 524, 525, 149; 239/327, 343, 370, 458, 539

[56] References Cited

U.S. PATENT DOCUMENTS

| | | | |
|---|---|---|---|
| 3,120,910 | 2/1964 | Nyden | 222/525 |
| 4,156,505 | 5/1979 | Bennett | 239/343 X |
| 4,274,594 | 6/1981 | Ito | 239/343 X |

*Primary Examiner*—Andres Kashnikow

*Attorney, Agent, or Firm*—Charles A. Brown

[57] ABSTRACT

A foam liquid dispensing device which mixes liquid capable of foaming and air together and dispenses the mixture as aerosol. The dispensing device comprises a container and a cap detachably attached to the container. The cap includes an outer cover and an inner cover. The outer cover includes a frusto-conical upper portion provided on the top with a jet nozzle. The inner cover includes an inner cylindrical portion having a frusto-conical portion extending upwardly therefrom and provided with a discharge port and a plug at the upper end of the frusto-conical portion, with the frusto-conical portion and plug defining a flow passage in cooperation with the frusto-conical portion of the outer cover. An inverted cylindrical porous member is disposed within the inner cover and has a mixing chamber therein and is provided with an outlet at the top. A check valve is disposed within the mixing chamber below the outlet. A tubular support member is received in the mixing chamber and a pipe is disposed between the container and tubular support member whereby one fluid from the container flows through the interior of the tubular member into the mixing chamber and the other fluid from the container flows through a side flow path defined between the annular support member and is cylindrical skirt of the inner cover and pores in the porous member into the mixing chamber to mix with the one fluid therein. When the container is compressed, the check valve clogs the outlet and the air and liquid mixture flows through the porous member to form an aerosol which flows through the jet nozzle.

13 Claims, 4 Drawing Figures

FOAM LIQUID DISPENSING DEVICE

FIELD OF THE INVENTION

This invention relates to a foam liquid dispensing device which is simple in construction and production, which allows replacing air to smoothly flow into the container of the dispensing device and which enables liquid to foam promptly and repeatedly.

PRIOR ARTS

Prior art foam liquid dispensing devices had the disadvantages that they are complicate in construction and not easy in production and assembling.

In addition, any one of the prior art foam liquid dispensing devices also had the disadvantage that each time the device dispensed a metered amount of foam liquid therefrom, the open air took a relatively long time to flow into the container so as to replace the air discharged from the container of the device which made it difficult to dispense the foam liquid repeatedly in a brief time.

SUMMARY OF THE INVENTION

Therefore, one principal object of the present invention is to provide a foam liquid dispensing device which contains liquid capable of foaming and air in the thermoplastic synthetic resin flexible container of the device, mixes the liquid and air in the container to provide aerosol and easily dispenses the aerosol in a metered amount each time the container is compressed.

Another object of the present invention is to provide a foam liquid dispensing device which contains liquid capable of foaming and air in the container of the device, mixes the liquid and air to provide aerosol in the container and dispenses the aerosol in a metered amount in a simple manner with the device maintained in its erect of upside-down position.

A further object of the present invention is to provide a foam liquid dispensing device which can dispense aerosol in a metered amount rapidly and repeatedly.

A still further object of the present invention is to provide a foam liquid dispensing device comprising components which can be easily produced and assembled together.

The above and other objects and attendant advantages of the present invention will be more readily apparent to those skilled in the art from a reading of the following detailed description in conjunction with the accompanying drawings which show preferred embodiments of the present invention for illustration purpose only, but not for limiting the scope of the same in any way.

PREFERRED EMBODIMENTS OF THE INVENTION

Figure 1:
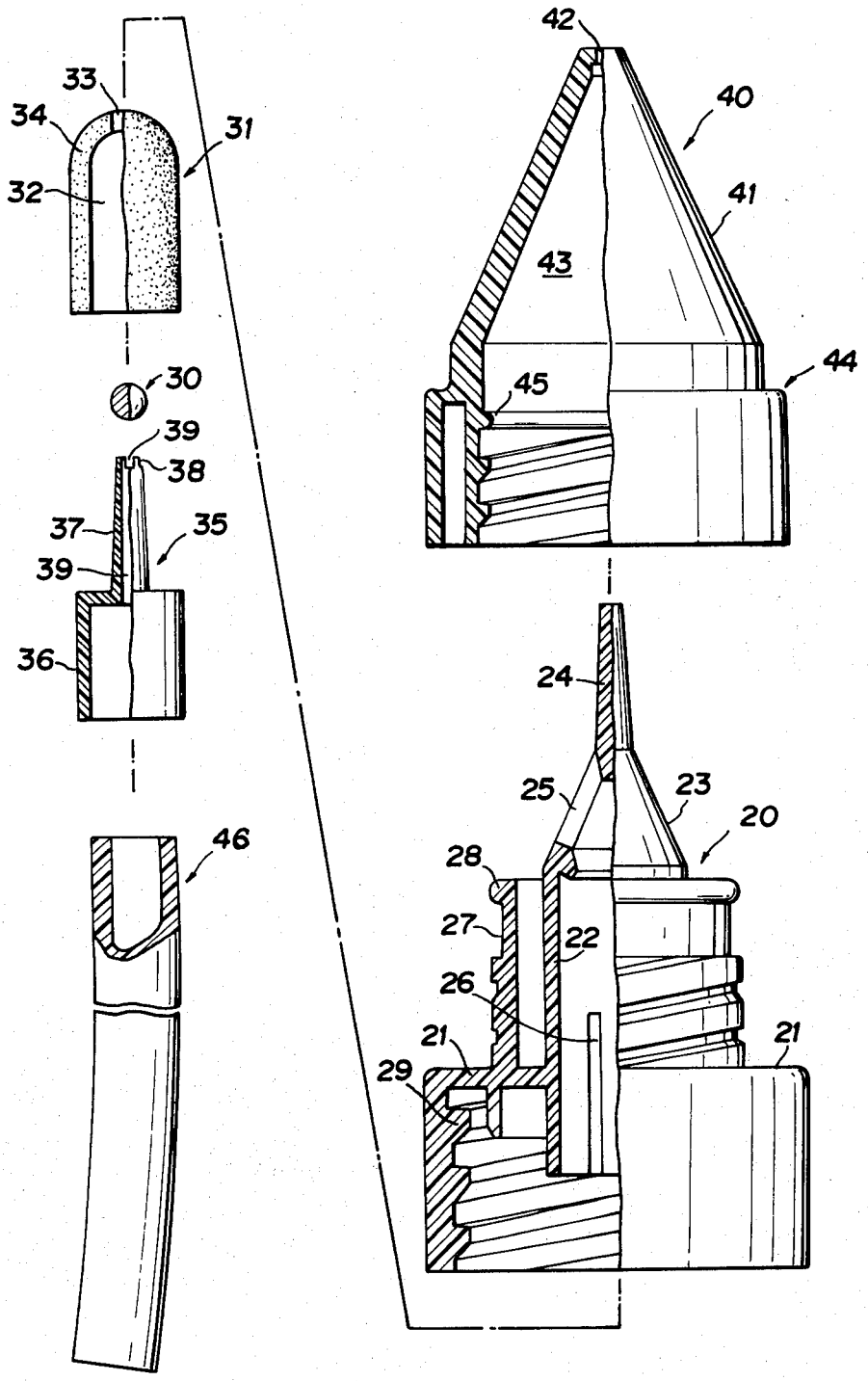
FIG. 1 is an exploded elevational view in partial section of the foam liquid dispensing device constructed in accordance with the present invention showing the manner in which the components of the device are assembled together.
Figure 2:
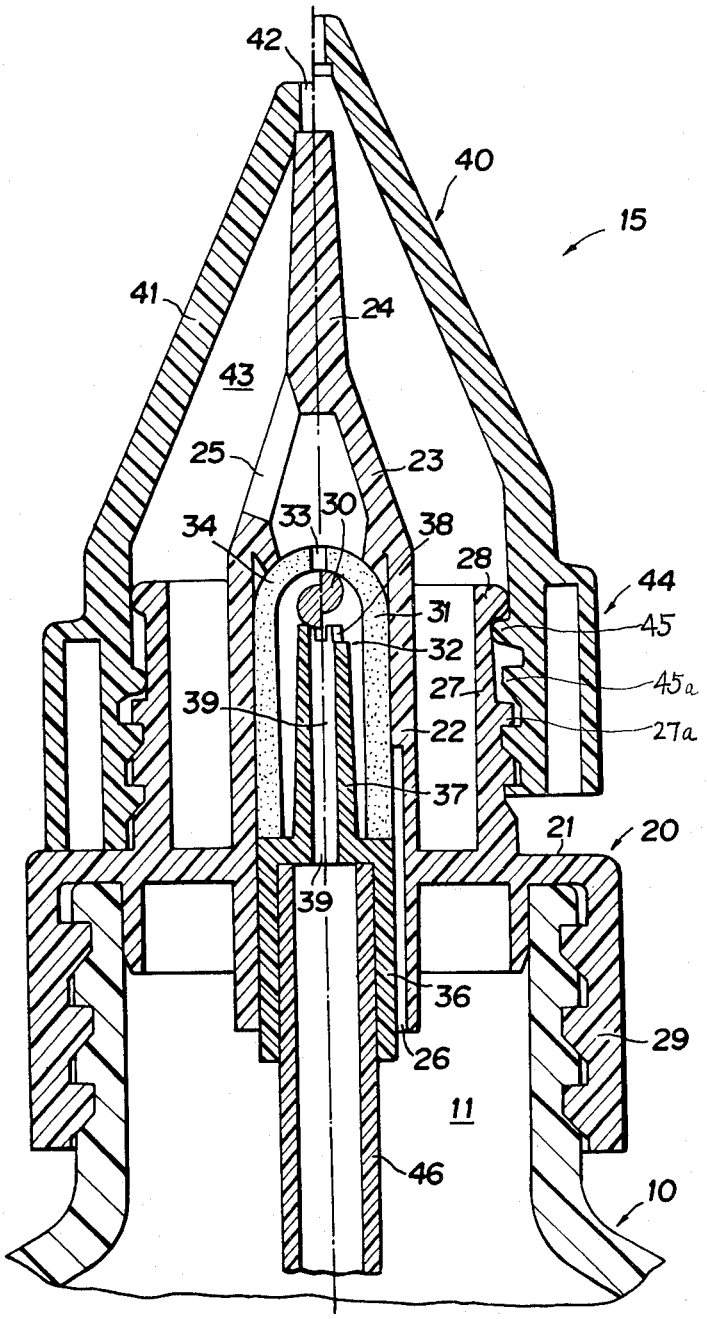
FIG. 2 is a vertically sectional view on an enlarged scale of said foam liquid dispensing device as shown in its assembled condition wherein the left-hand half portion thereof shows the jet nozzle as closed by the outer cover and the right-hand half portion shows the jet nozzle in its open condition with the outer cover being maintained in its raised position.

The present invention will be now described referring to the accompanying drawings and more particularly, to FIGS. 1 and 2 in which the first embodiment of the foam liquid dispensing device of the invention is shown.

The foam liquid dispensing device of the invention generally comprises a cylindrical container 10 having the neck 11 and a cap 15 adapted to be detachably fitted on the neck 11 and including an outer cover 40, an inner cover 20, a porous member 31 and a support member 35. The inner cover 20 adapted to be screwed onto the neck 11 of the container 10 integrally includes a cylindrical skirt 21 and an inner cylindrical portion 22 extending vertically through the skirt 21 substantially in the central area thereof. The inner cylindrical portion 22 tapers upwardly to provide a frusto-conical portion 23 having an upwardly tapered bar-shaped plug 24 at the upper end thereof and a suitable foam liquid discharge port 25 formed in one side of the frusto-conical portion 23. The inner periphery of the skirt 21 is formed with threads 29 for engagement with the mating threads on the outer periphery of the container neck 11.

The inner cover 20 further includes an integral outer cylindrical portion 27 extending upwardly from the skirt 21 and surrounding the inner cylindrical portion 22 in peripherally spaced relationship to the latter. The outer cylindrical portion 27 has an annular bulge 28 about the upper end and threads **27*a* on the outer periphery below the annular bulge 28** for the purpose to be described hereinafter.

As more clearly shown in FIG. 2, disposed within the inner cylindrical portion 22 are an inverted cylindrical porous member 31 closely fitted in the cylindrical portion 22 and open at the bottom and having a dome-shaped top 34, a spherical check valve 30 positioned within the porous member 31 and a support member 35 received within the porous member 31 for supporting the check valve 30. The porous member 31 defines a mixing chamber 32 in the cavity therein and has a center outlet 33 in the dome-shaped top 34. The support member 35 includes a larger diameter lower portion 36 closely fitted within the lower portion of the inner cylindrical portion 22 and a reduced diameter tapered prop 37 extending upwardly from the lower cylindrical portion 36 in the central area thereof. A through opening 39 extends vertically the lower cylindrical portion 36 and prop 37 and a notch 38 is formed at the leading or upper end of the prop 37. A pipe 46 is fitted within the lower cylindrical portion 36 of the support member 35 and extends downwardly from the portion 36 into the container 10.

The outer cover member 40 is screwed onto the inner cover member 20 by means of the threads 27*a* and 45*a* formed on the inner and outer cover members 20 and 40, respectively. When the outer cover member 40 has been fully screwed onto the inner cover member 20, the plug 24 closes the jet nozzle 42 as shown in the left-hand half portion of FIG. 3.

With the above-mentioned construction and arrangement of the elements of the cap 15, when the outer cover 40 is unscrewed from the inner cover 20 and the container 10 is compressed on the side thereof with high manual force, the liquid capable of foaming within the container 10 is forced out of the container 10 and passes through upwardly the pipe 46 and then the through opening 39 and notch 38 in the support member 35 into the mixing chamber 32 in the porous member 31 while pushing the check valve 30 upwardly to unseat the valve from the notch 38. On the other hand, the air entrapped within the container 10 is forced to pass through the air passage 26 defined between one or the right-hand sides of the porous member 31 and of the lower cylindrical portion 36 of the support member 35 (as seen in FIG. 2) and the opposing inner side of the inner cylindrical portion 22 of the inner cover 20 and through pores in the porous member 31 into the mixing chamber 32 in the porous member 31. At this time, since the pressure within the container 10 is higher than that of the open air, the air entrapped within the container 10 passes through the air passage 26 and pores in the porous member 31 into the mixing chamber 32 and the liquid capable of foaming within the container 10 is discharged out of the container through the pipe 46 and the through opening 39 in the support member 35 into the mixing chamber 32, the check value 30 is pushed upwardly to clog the outlet 33 in the porous member 31 as shown in the right-hand portion of FIG. 2. Thus, the liquid capable of foaming mixes with the air within the mixing chamber 32 and the mixture issues out of the outlet 33 in the top 34 of the porous member 31 as foam liquid and the foam liquid then passes through the discharge port 25 in the inner cover 20 and the passage 43 defined between the inner and outer covers 20, 40 into the jet nozzle 42 from where the foam liquid is dispensed.

After a desired amount of the foam liquid has been dispensed from the dispensing device, when the compression force applied to the container is removed therefrom, the container tends to return to its original shape by its inherent restoring force to thereby reduce the internal pressure within the container to a negative pressure whereupon the now raised check valve 30 is allowed to descend to open the outlet 33 in the top 34 of the porous member 31 as shown in the left-half portion of FIG. 2 to allow the open air to flow through the outlet 33 and through opening 39 and the pipe 46 into the container. However, the open air is not allowed to pass through the porous member 31 which presents a high resistance to the passage of the air therethrough into the container, but rapidly flows through the notch 38 in the top of the support member 35, the through opening 39 in the support member 35 and the pipe 46 into the container 10. Thus, the container promptly returns to its original shape ready for a next compression whereby a repeated compression and release cycle can be performed rapidly.

When the container is compressed on the side thereof in its upside-down position, on one hand, the liquid capable of foaming flows from the container 10 through the side passage 26 and the pores in the porous member 31 into the mixing chamber 32 defined in the porous member and on the other hand, the air flows from the container 10 through the pipe 46, the through opening 39 in the support member 35 and the pores in the porous member 31 into the mixing chamber 32 to mixes with the liquid in the mixing chamber to provide foam liquid which then passes through the discharge port 25 and the flow passage 43 into the jet nozzle 42 from which the foam liquid is dispensed as mentioned hereinabove. Thereafter, when the compressing force applied to the container is released therefrom with the dispensing device maintained in its upside-down position, since the pressure within the container is reduced to a negative pressure, the open or external air pushes the check valve 30 upwardly and flows through the outlet 33, notch 38, through opening 39 and pipe 46 into the container 10. Thus, a repeated compression can be then simply and promptly performed as mentioned hereinabove.

The cap 15 of the present invention has the following advantages in the production thereof in addition to those in the operation of the dispensing device:

That is, the container 10, pipe 46 and check valve 30 are of simple cylindrical shape, the outer cover 40 having the jet nozzle 42 is of simple threaded cylindrical shape, the support member 35 consists of the larger diameter lower cylindrical portion 36 and the reduced diameter prop 37 and is provided with only the inner through opening 39 and the top notch 38, and thus, these components are easily produced. Since the inner cover 20 includes the inner cylindrical portion 22 extending through the skirt 21 substantially in the central area thereof and integrally having the frusto-conical portion 23 provided with the foam liquid discharge port 25 and the plug 24 at the top of the frusto-conical portion 23; and the outer cylindrical portion 27 extending uprightly from the skirt 21 and provided with the external threads 27*a*, the inner cover 20 is of simple shape and easy in production. The components of the cap can be easily assembled by interfitting with each other and screwing one into and onto another not requiring any special tooling for the assembling of the components.

Figure 3:
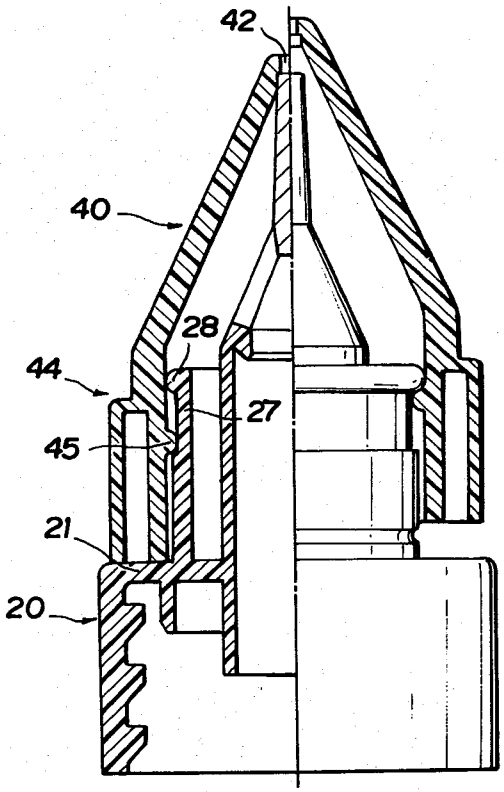
FIG. 3 is a schematic elevational view in partial section of said foam liquid dispensing device of FIG. 1 wherein the left-hand half portion shows the engagement between the outer cylindrical portion of the inner cover and the outer cover by means of the annular bulges formed at the upper end of the outer cylindrical portion of the inner cover and on the inner periphery of the inner cover.

In the illustrated embodiment, althrough the side flow path 26 defined between the support member 35 and the inner cylindrical portion 22 of the inner cover 20 is formed by the vertical groove in the inner surface of the inner cylindrical portion 22 extending from the lower end to an intermediate position between the lower and upper ends of the inner cylindrical portion, the flow path may be formed by one or more grooves provided on the outer periphery of the support member 35 extending the whole length of the member. And the connection between the outer cylindrical portion 27 of the inner cover 20 and the outer cover 40 is not limited to the illustrated threaded engagement, but the outer cylindrical portion 27 and the outer cover 40 may be connected together only by means of the outer annular bulge 28 at the upper end of the inner cover outer cylindrical portion 27 and the inner annular engaging bulge 45 on the inner surface of the skirt 44 of the outer cover 40 as shown in FIG. 3. It is only required that the outer cover 40 is prevented from inadvertently disengaged from the inner cover 20 in use and yet easily removed from the inner cover 20 by vertically sliding the outer cover relative to the inner cover when desired.

Figure 4:
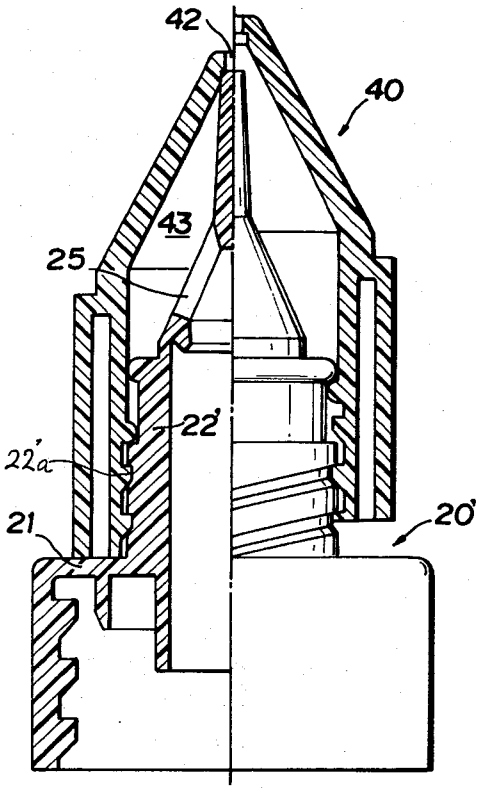
FIG. 4 is a schematic elevational view in partial section of a modified embodiment of the foam liquid dispensing device according to the present invention wherein the left-hand half portion shows the modified inner cover having only one cylindrical portion the outer periphery of which is formed with threads on which the outer cover is screwed.

Although the inner cover 20 in the foregoing embodiment consists of the outer and inner cylindrical portions 22, 27, the invention is not limited to such arrangement of the inner cover 20. In the embodiment as shown in FIG. 4, the outer cylindrical portion 22 is eliminated and instead, the modified inner cover 20' consists of a single cylindrical portion 22' which is provided on the outer periphery with threads 22'a for engagement with the mating threads on the inner surface of the outer cover 40. Since the modified embodiment of FIG. 4 is substantially similar to the foregoing embodiment except for the inner cover 20', description on the other components of the modified embodiment will be omitted herein.

It is only necessary that the inner and outer covers 20', 40 engage each other in such a peripherally spaced relationship so as to leave a space therebetween for forming the flow path 43.

While particular embodiments of this invention have been shown in the drawings and described hereinabove, it will be apparent that many changes may be made in the form, arrangement and positioning of the various elements of the combination. In consideration thereof it should be understood that preferred embodiments of this invention described herein are intended to be illustrative only and not intended to limit the scope of the invention.

What is claimed is:

1. In a foam liquid dispensing device adapted to mix liquid capable of foaming and air together and dispense said mixture as foam liquid, characterized by a cylindrical container having a neck provided on the outer periphery of the neck with threads; a cap adapted to be detachably fitted on said container and including an outer cover having an upwardly tapered upper portion provided at the upper end with a foam liquid jet nozzle and an integral lower cylindrical skirt provided on the inner periphery with threads and a coaxial inner cover having a lower cylindrical skirt, an outer cylindrical portion extending upwardly from said skirt of the inner cover and an integral inner cylindrical portion extending upwardly and downwardly through said skirt of the inner cover and surrounded by said outer cylindrical portion in peripherally spaced relationship to the latter, said inner cylindrical portion integrally having a frusto-conical portion extending upwardly from said inner cylindrical portion and provided with a discharge port and a plug extending upwardly from said frusto-conical portion and adapted to clog said jet nozzle whereby the upwardly tapered portion of said outer cover and said inner cover define a flow path therebetween in communication with said discharge port, a cylindrical porous member disposed within said inner cylindrical portion of the inner cover above said skirt of the inner cover to define a mixing chamber therein and having an outlet at the top, a check valve normally positioned below said outlet to close the outlet in the porous member, a tubular support member having a lower cylindrical portion disposed within said inner cylindrical portion of the inner cover below said lower skirt of the inner cover and an upper tapered portion extending upwardly from said lower cylindrical portion of the support member into said mixing chamber, there being a side flow path from the exterior of said porous member into the container between said lower cylindrical portion of said support member and said inner cylindrical portion of said inner cover, and a pipe extending between said container and said tubular support member whereby one fluid from said container flows through said support member into said mixing chamber and the other fluid from said container flows through said side flow path and pores in said porous member into the mixing chamber to mix with said one fluid.

2. The foam liquid dispensing device as set forth in claim 1, in which said container is squeezable when said container is compressed by squeezing, said check valve clogs said outlet and the air and liquid mixture flows through pores in said porous member in the portion of the porous member except at said outlet and through said flow path to said jet nozzle from where the mixture is dispensed as an aerosol.

3. The foam liquid dispensing device as set forth in claim 1, in which the inner periphery of said skirt of the inner cover is provided with threads for engaging said threads on the outer periphery of the neck of the container.

4. The foam liquid dispensing device as set forth in claim 1, in which the outer periphery of said outer cylindrical portion of the inner cover is provided with threads for engaging said threads on the inner periphery of the skirt of said outer cover.

5. The foam liquid dispensing device as set forth in claim 1, in which the outer periphery of the portion of said tubular support member received within said inner cylindrical portion of the inner cover is provided with at least one groove extending along the length of the support member portion to form said side flow path.

6. The foam liquid dispensing device as set forth in claim 1, in which said skirt of the outer cover is a double-walled cylindrical construction including an inner cylindrical portion and an outer cylindrical portion surrounding said inner cylindrical portion in peripherally spaced relationship thereto and said inner cylindrical portion is provided on the inner periphery for engagement with said threads on the outer periphery of said outer cylindrical portion of the inner cover to thereby connect between the inner and outer covers.

7. The foam liquid dispensing device as set forth in claim 1, in which said outer cylindrical portion of the inner cover is provided about the upper end with an annular bulge and said inner cylindrical portion of the double-walled outer cover is provided on the inner periphery with an annular bulge for engagement with said annular bulge on the inner cylindrical portion of the inner cover to thereby engage the inner and outer covers each with the other.

8. A foam liquid dispensing device adapted to mix liquid capable of foaming and air together and to dispense the mixture as foam liquid, said foam liquid dispensing device comprising;

a squeezable cylindrical container having a neck provided on the outer periphery of the neck with threads, a cap adapted to be detachably fitted on said container and including an axially outer cover having an upwardly tapering upper portion provided at an upper end with a foam liquid jet nozzle and having an integral lower cylindrical skirt provided on an inner periphery thereof with connecting means, and a coaxial axially inner cover having a cylindrical skirt on an inner periphery of which are formed threads for engagement with said threads on said container neck, said inner cover also including an axially outer cylindrical portion extending upwardly from said skirt of said inner cover, said axially outer cylindrical portion having on an outer periphery thereof means for mating with said connecting means on said inner periphery of said outer cover, said axially inner cover also having an integral radially inner cylindrical portion extending upwardly and downwardly through said skirt of said axially inner cover and being surrounded by said axially outer cylindrical portion in peripherally spaced relation, said radially inner cylindrical portion of said inner cover having an integral frusto-conical portion extending upwardly therefrom, said frusto-conical portion being provided with a discharge port, a plug extending upwardly from said frusto-conical portion, said plug being adapted to clog said jet nozzle, whereby said upwardly tapered portion of said axially outer cover and said axially inner cover define a flow path therebetween in communication with said discharge port, a cylindrical porous member disposed within said radially inner cylindrical portion of said axially inner cover above said skirt of said axially inner cover and defining a mixing chamber within said radially inner cylindrical portion and having an outlet at its top, and a tubular support member having a lower cylindrical portion disposed within said radially inner cylindrical portion and extending downwardly within said skirt of said axially inner cover, said tubular support member also having an upper tapered portion extending upwardly from said lower cylindrical portion of said support member into said mixing chamber, said upper tapered portion having an open upper end and defining a through opening, a check valve movably positioned within said porous member between said outlet in said porous member and said open upper end of said tapered portion, at least one flow path extending between said mixing chamber and said container through said porous member, said at least one flow path having a portion extending between said lower portion of said tubular support member and said radially inner cylindrical portion of said axially inner cover, and a pipe extending between said container and said lower portion of said tubular support member, whereby when the container is compressed by squeezing after releasing the contact between said jet nozzle and said plug a selected one of liquid capable of foaming and air from the container flows through said pipe and said support member and the other one of air and liquid capable of foaming flows through said at least one flow path and pores in said porous member into said mixing chamber to mix with each other.

9. The foam liquid dispensing device as set forth in claim 8, in which when said container is squeezed, said check valve clogs said outlet and the air and liquid mixture flows through pores in said porous member except at said outlet and through said flow path to said jet nozzle from where the mixture is dispensed as an aerosol.

10. The foam liquid dispensing device as set forth in claim 8 in which said connection means provided on the inner periphery of said lower skirt of said axially outer cover and said means for mating with said connecting means provided on the outer periphery of said outer cylindrical portion of said axially inner cover are threads engaging each other.

11. The foam liquid dispensing device as set forth in claim 8 in which said connecting means provided on the inner periphery of said lower skirt of said axially outer cover is an annular bulge, and said means for mating with said connecting means provided on the outer periphery of said outer cylindrical portion of said axially inner cover is an annular bulge for engagement with said annular bulge on said axially outer cover.

12. The foam liquid dispensing device as set forth in claim 8 in which said flow path communicating between said porous member and the container is a groove in the inner surface of said radially inner cylindrical portion of said axially inner cover.

13. The foam liquid dispensing device as set forth in claim 8 wherein there is at least one notch in said upper tapered portion at the upper end of said upper tapered portion.

* * * * *